US009301603B1

(12) United States Patent
Koehn et al.

(10) Patent No.: US 9,301,603 B1
(45) Date of Patent: Apr. 5, 2016

(54) COLLAPSIBLE STORAGE CABINET

(71) Applicant: QUALITY CRAFT INDUSTRIES INC., Surrey (CA)

(72) Inventors: Vincent George Koehn, Montezuma, KS (US); Barry Kane Retchloff, Rogerville, MO (US)

(73) Assignee: QUALITY CRAFT INDUSTRIES, INC., Surrey, British Columbia (CA)

( * ) Notice: Subject to any disclaimer, the term of this patent is extended or adjusted under 35 U.S.C. 154(b) by 0 days.

(21) Appl. No.: 14/511,125

(22) Filed: Oct. 9, 2014

(51) Int. Cl.

| | |
|---|---|
| ***A47B 43/00*** | (2006.01) |
| ***A47B 47/00*** | (2006.01) |
| ***A47B 96/02*** | (2006.01) |
| ***E06B 3/70*** | (2006.01) |

(52) U.S. Cl.
CPC ..... *A47B 43/00* (2013.01); *A47B 47/00* (2013.01); *A47B 96/02* (2013.01); *E06B 3/70* (2013.01)

(58) Field of Classification Search
CPC ..... A47B 43/00; A47B 43/003; A47B 43/02; A47B 47/00; A47B 47/006; A47B 47/0075; A47B 47/02; A47B 47/03; A47B 57/06; A47B 57/08; A47B 57/10; A47B 61/00
USPC ..... 312/257.1, 258, 262, 263, 7.2, 348.1, 312/348.2, 348.4, 107, 108
See application file for complete search history.

(56) References Cited

U.S. PATENT DOCUMENTS

| | | | | |
|---|---|---|---|---|
| 655,952 | A * | 8/1900 | Beerling | A47F 3/005 312/114 |
| 889,741 | A | 6/1908 | Additon | |
| 963,769 | A | 7/1910 | Johnson et al. | |
| 1,729,475 | A * | 9/1929 | Brainard et al. | 312/265.2 |
| 2,205,826 | A * | 6/1940 | Small | 220/668 |
| 2,934,389 | A | 4/1960 | Krey | |
| 3,294,464 | A | 12/1966 | Harold | |
| 3,563,627 | A * | 2/1971 | Whipps | 312/265.2 |
| 4,288,132 | A * | 9/1981 | Znamirowski et al. | 312/265.5 |
| 5,299,704 | A | 4/1994 | Thorby | |
| 5,372,262 | A * | 12/1994 | Benson et al. | 211/26 |
| 5,664,854 | A | 9/1997 | Letch | |
| 6,209,976 | B1 * | 4/2001 | Shear | 312/263 |
| 6,478,391 | B1 * | 11/2002 | Stoever | 312/265.5 |
| 6,561,601 | B1 * | 5/2003 | Maffeo | 312/257.1 |
| 6,948,787 | B2 | 9/2005 | McBrayer, III et al. | |
| 7,086,707 | B2 * | 8/2006 | Wyatt et al. | 312/265.4 |
| 7,866,770 | B2 * | 1/2011 | Wu | 312/263 |
| 2007/0210682 | A1 * | 9/2007 | Wise | 312/108 |
| 2008/0012455 | A1 * | 1/2008 | Zheng | 312/262 |
| 2011/0115350 | A1 | 5/2011 | Tsai et al. | |

* cited by examiner

*Primary Examiner* — Andrew Roersma
(74) *Attorney, Agent, or Firm* — Shook, Hardy & Bacon L.L.P.

(57) ABSTRACT

A collapsible storage cabinet having an improved structure and assembly technique is disclosed. The storage cabinet is designed to collapse to a compact size to minimize required shipping and retail space usage, while providing for ease of assembly by a consumer and improved structural design via recessed top and bottom walls. The collapsible storage cabinet includes a collapsible subassembly having a front wall, an opposing back wall, and a pair of folding sidewalls extending between and coupling the front wall and back wall. Top and bottom walls are selectively secured to the subassembly to maintain the cabinet in a fully assembled state.

17 Claims, 6 Drawing Sheets

COLLAPSIBLE STORAGE CABINET

CROSS-REFERENCE TO RELATED APPLICATIONS

None.

TECHNICAL FIELD

The present invention relates to a collapsible storage cabinet. More specifically, embodiments of the present invention relate to a collapsible storage cabinet having ease of assembly, improved stability when assembled, and an improved configuration for packaging when in a collapsed state.

BACKGROUND OF THE INVENTION

Storage cabinets are well known and utilized in a variety of locations in homes and businesses to satisfy several needs. Storage cabinets come in many shapes and sizes to meet these wide-ranging needs. The storage cabinets may be provided to a consumer in a fully assembled state or a disassembled state, requiring the consumer to then assemble the cabinet. From a consumer perspective, it is advantageous for the storage cabinet to be fully assembled when purchased, as it is ready to use. In fact, a number of storage cabinets are manufactured and shipped in a fully assembled state. However, shipping storage cabinets in a fully assembled state requires sizeable amounts of packaging and space when in transit, resulting in increased shipping costs. These higher costs are typically passed on to the consumer through the price of the storage cabinet. Storing fully assembled storage cabinets also requires large amounts of storage space. Occupying large amounts of both storage and display space at a retailer can result in fewer cabinets being ordered by retailers due to limited inventory/display space, and therefore fewer cabinets available for consumers to purchase.

From a manufacturer, transport, and retail perspective, it is more advantageous to provide the storage cabinet to the consumer in a disassembled state, such that the pieces of the cabinet can be packaged in a more efficient manner, such as in a flat and stackable box. However, requiring a consumer to assemble a cabinet having many pieces may prevent some consumers from purchasing the cabinet.

Furthermore, storage cabinets of the prior art which are designed to be assembled by the consumer are often times constructed in a way to promote easier assembly. However, such storage cabinets may not provide as much structural integrity as storage cabinets designed to be assembled at a factory and shipped as a finished unit.

SUMMARY

In accordance with the present invention, there is provided a novel and improved storage cabinet which seeks to overcome the shortcomings of the prior art. In an embodiment of the present invention, a collapsible storage cabinet is provided having a front wall, an opposing back wall, a pair of folding sidewalls, a top wall, and a bottom wall, where the top and bottom walls are secured to the front, back and sidewalls in a way so as to be recessed within a top opening and bottom opening.

In an alternate embodiment of the present invention, a wall member for a collapsible storage cabinet is provided. The wall member comprises a generally planar body, a pair of first support walls oriented generally perpendicular to the generally planar body with each of the first support walls also having a first lip oriented parallel to the generally planar body. The wall member also has a pair of second support walls oriented generally perpendicular to both the generally planar body and the first support walls with each of the second support walls also having a second lip oriented parallel to the generally planar body.

In another embodiment of the present invention, a collapsed storage cabinet is provided comprising a front wall having a first pair of generally planar end faces, a back wall opposite the front wall and parallel thereto and having a second pair of generally planar end faces. The collapsed storage cabinet also comprises a pair of collapsible sidewalls with each sidewall having a plurality of hinged panels where the panels are in contact with each other and positioned such that the first pair of generally planar end faces are adjacent to and parallel to the second pair of generally planar end faces.

Additional advantages and features of the present invention will be set forth in part in a description which follows, and in part will become apparent to those skilled in the art upon examination of the following, or may be learned from practice of the invention. The instant invention will now be described with particular reference to the accompanying drawings.

BRIEF DESCRIPTION OF THE SEVERAL VIEWS OF THE DRAWINGS

The present invention is described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different components, combinations of components, steps, or combinations of steps similar to the ones described in this document, in conjunction with other present or future technologies.

Figure 1:
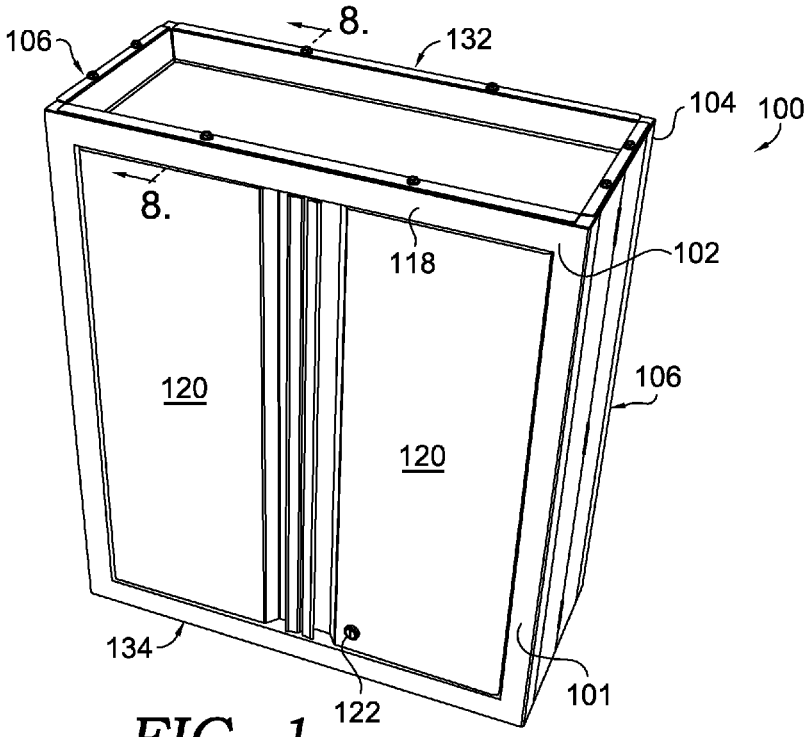
FIG. 1 is a perspective view of an embodiment of a collapsible storage cabinet in a fully assembled condition.
Figure 3:
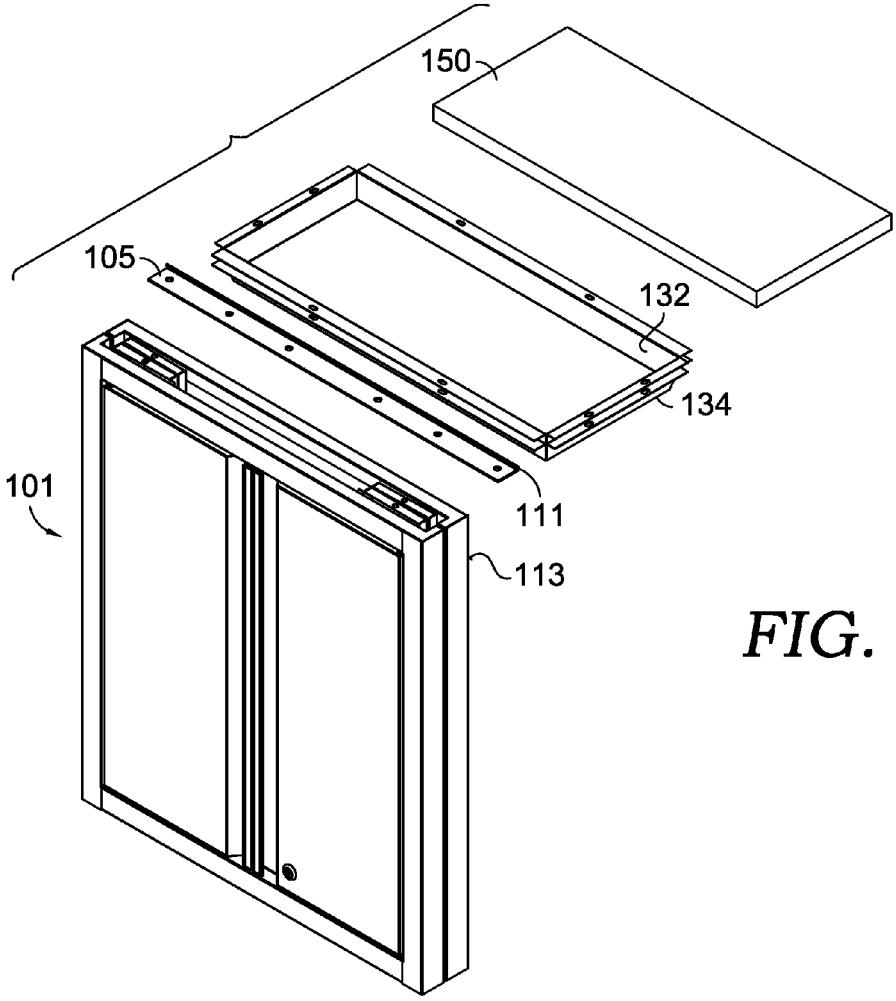
FIG. 3 is a perspective view of the storage cabinet of FIG. 1 in a collapsed condition once removed from the packaging of FIG. 2 and with portions removed from an interior cavity defined by the collapsed cabinet.

Referring initially to FIG. 1, a collapsible storage cabinet 100 is depicted in its fully assembled condition. The collapsible storage cabinet 100 of the present invention can serve a variety of uses. One such use is being in a garage to store tools, supplies or other similar equipment. The collapsible storage cabinet 100 includes a collapsible subassembly 101 having a front wall 102 and an opposing back wall 104 spaced a distance apart when the cabinet is in the fully assembled condition. Referring to FIG. 3, the collapsible storage cabinet 100 is provided with a bracket 105 for hanging the cabinet 100 from a wall, if desired. The bracket 105 would be mounted to the wall and the storage cabinet would be supported thereon by way of a lip 111 along an edge of the bracket 105 interlocking with a corresponding lip 113 extending from the back side of the rear wall 104.

Figure 4:
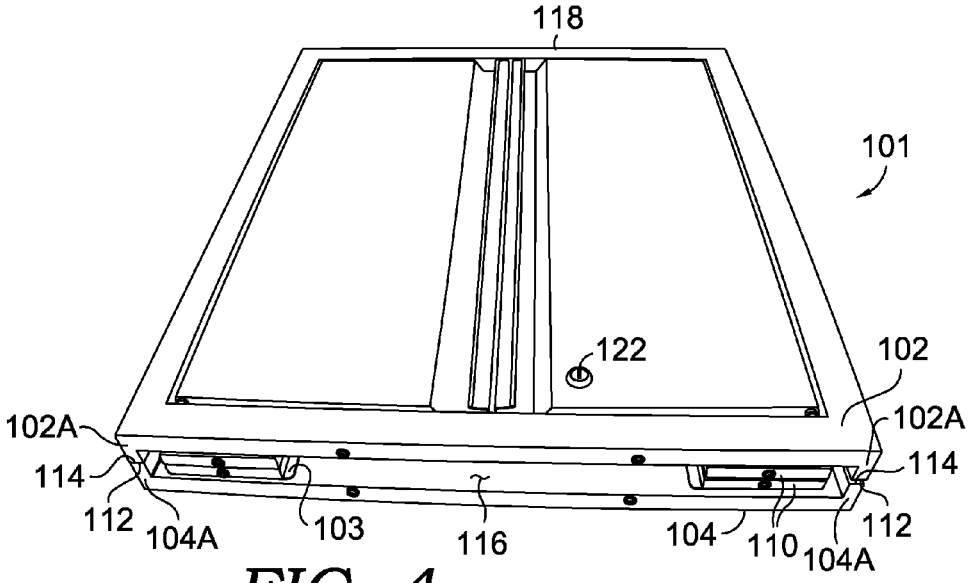
FIG. 4 is an alternate perspective view of the collapsible subassembly of the storage cabinet of FIG. 3.
Figure 5:
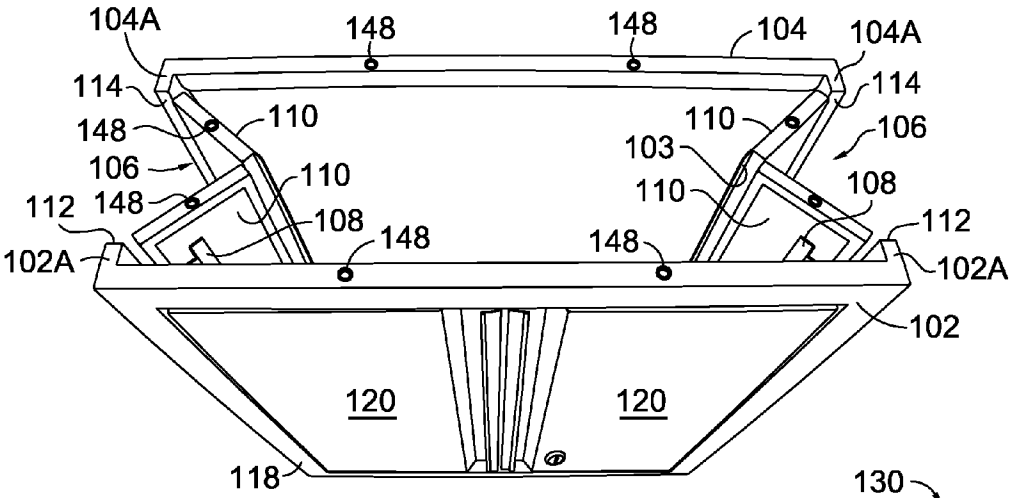
FIG. 5 is a perspective view of the storage cabinet of FIG. 3 in a partially expanded condition.

The collapsible storage cabinet 100 also comprises a pair of folding sidewalls 106 extending between and coupling the front wall 102 and back wall 104, as shown in FIGS. 1 and 5. The folding sidewalls 106 are connected to the front wall 102 and back wall 104 by a hinge 108 (FIGS. 5 and 7) or other comparable device. The hinge 108 permits the one or more panels 110, which form the sidewalls 106, to collapse as shown in FIGS. 2-5.

Figure 2:
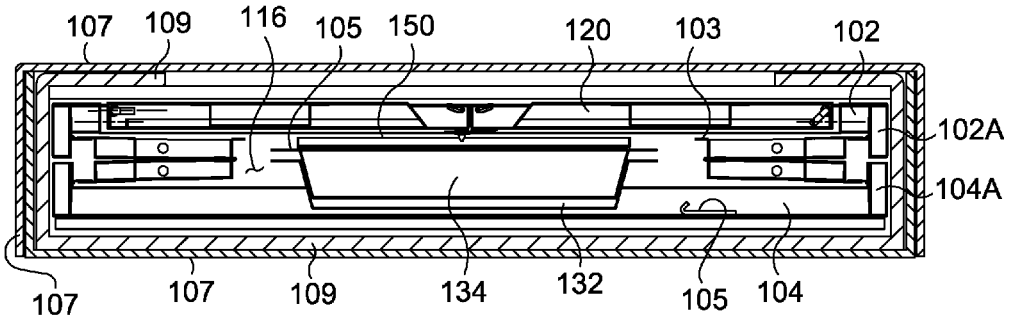
FIG. 2 is a cross-sectional side elevation view of the storage cabinet of FIG. 1 in a collapsed condition and packaged for shipment by the manufacturer.

Referring now to FIGS. 2, 4, and 5, the front wall 102 and back wall 104 each comprise additional structural features which aid in the packaging of the storage cabinet 100 in its collapsed condition for shipment and storage. More specifically, the front wall 102 further comprises a pair of extensions 102A and corresponding first pair of generally planar end faces 112 which extend from the front wall 102. The back wall 104, similarly, also has a pair of extensions 104A and a corresponding second pair of generally planar end faces 114. The first and second generally planar end faces 112 and 114 are located such that when the storage cabinet 100 is in the fully collapsed state, as shown in FIG. 4, the first pair of generally planar end faces 112 are positioned adjacent to and parallel with the second pair of generally planar end faces 114, thereby forming an interior cavity or open region 116 between the front wall 102, the back wall 104, and the collapsed sidewalls 106.

Figure 7:
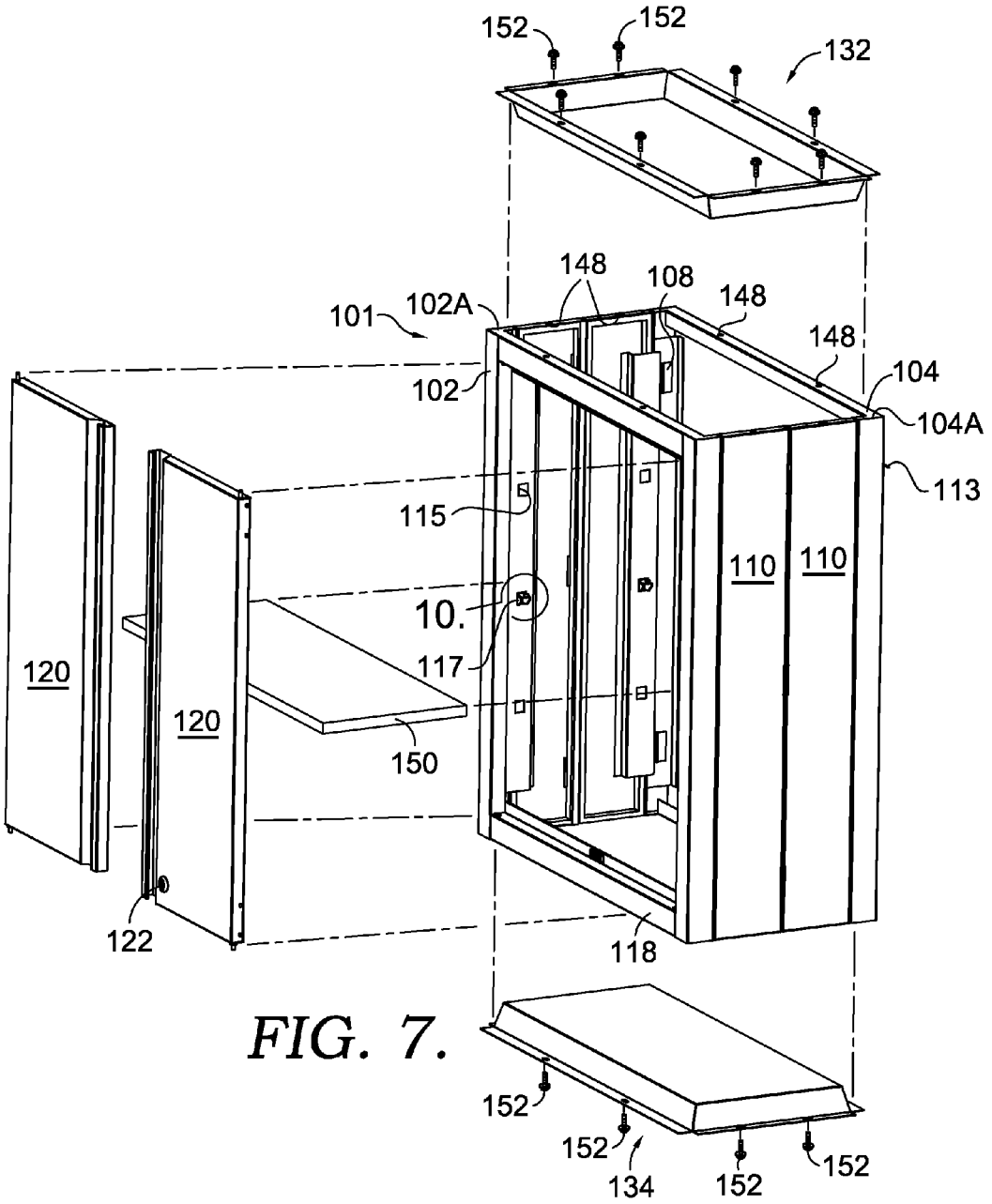
FIG. 7 is an exploded view of the storage cabinet of FIG. 1 depicting the collapsible subassembly, the top wall, the bottom wall, and the door panels.

As it can be seen in FIG. 4, when the storage cabinet 100 is in the collapsed condition, the plurality of panels 110 forming the pair of collapsible sidewalls 106 are folded so as to be in contact with each other. Furthermore, the plurality of panels 110 are folded so as to also be contained between the front wall 102 and back wall 104. That is, as can be seen in FIGS. 5 and 7, the plurality of panels 110 which form the collapsible sidewalls 106 are hinged to the extensions 102A of the front wall 102 and extensions 104A of the back wall 104 so that the hinges 108 are not visible from the exterior of the collapsible storage cabinet 100 when it is in its fully assembled position. A lip 103 extends beyond an inner edge of one of the panels 110 on each side to prevent the panels 110 from opening or flexing outward.

Figure 8:
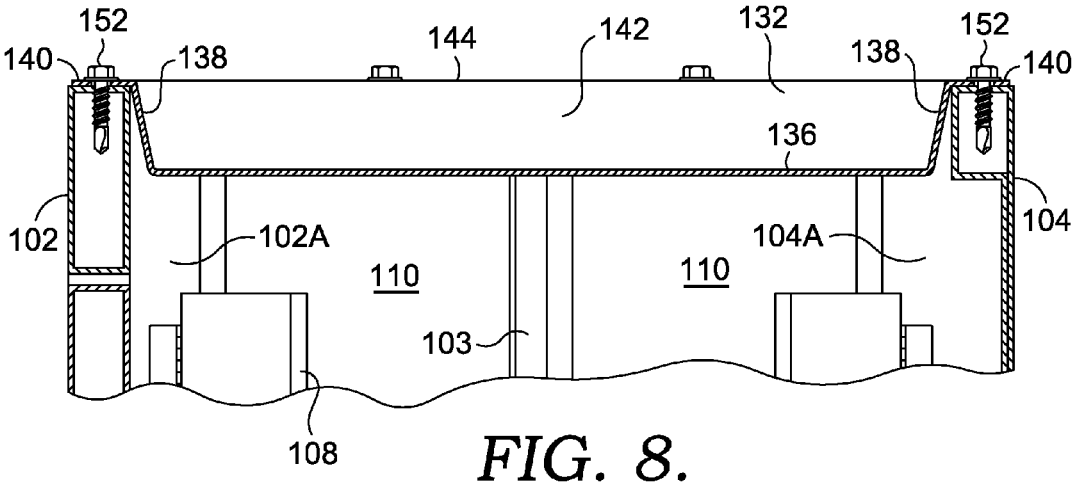
FIG. 8 is a cross-sectional view of a portion of the storage cabinet of FIG. 1 taken along the line 8-8.

Further, in the illustrated embodiment, the hinges 108 are not standard, piano-type hinges in that they do not directly couple interior corners of the extensions 102A, 104A to interior corners of the panels 110, as one would normally think a hinge would do. Instead of keeping the corners adjacent to each other throughout the collapsing of the cabinet 100, the hinges 108 are constructed to move the panels 110 between being aligned with the extensions 102A, 104A in the fully assembled position, as best illustrated in FIG. 7, to being adjacent the extensions 102A, 104A in the fully collapsed position, as best illustrated in FIG. 2. As illustrated in FIG. 2, the hinges 108 permit each panel to be moved to a location generally perpendicular to and next to or inside of, as opposed to cattycorner or diagonal, the extension to which it is connected. This moves the panels 110 out of the way so the front extensions 102A almost touch (or do touch) the rear extensions 104A. If the panels 110 were connected to the extensions 102A, 104A with piano hinges, the abutting panels 110 would space the extensions 102A, 104A further apart, thus making the depth (i.e., the vertical dimension in FIG. 2) of the collapsed cabinet unit greater. As illustrated in FIGS. 2, 5 and 8, the hinges 108 accomplish this by being attached to an inner face of the extensions 102A, 104A and an inner face of the panels 110. The hinges include an angled bracket portion that spans the space between the panels 110 and the extensions 102A, 104A in the fully assembled position.

Figure 10:
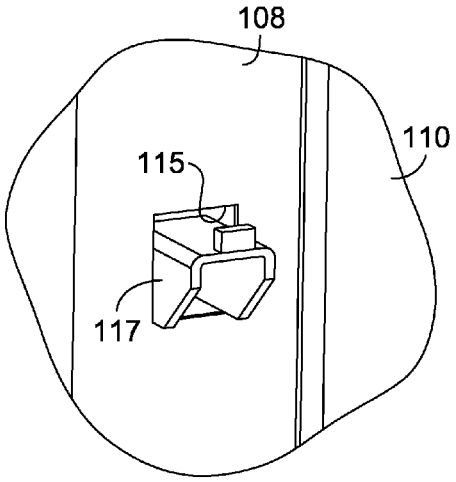
FIG. 10 is an enlarged, fragmentary, perspective view of a clip arrangement used to support a shelf in the collapsible storage cabinet taken in the area 10 of FIG. 7.

The hinges 108, as best seen in FIGS. 7 and 10, also include a plurality of openings 115 therein into which a clip 117 may be placed. A clip 117 may be placed in an opening in each of the hinges 108 at a same vertical height and the shelf 150 may be removably supported thereon.

The storage cabinet 100 further comprises a front frame 118, as shown in FIGS. 1, 4, and 5, with the front frame 118 encompassing one or more doors 120. As it can be seen from FIGS. 1, 4, 5, 7, and 9, the embodiment of the collapsible storage cabinet 100 depicted has two doors 120 which open outward, thereby providing access to the inside of the storage cabinet 100. The doors 120 are hinged to a side portion of the front frame 118 in a traditional cabinet-style arrangement. However, the exact number and arrangement of the one or more doors 120 can vary.

The one or more doors 120 and front frame 118 also include a locking mechanism 122 permitting the user of the storage cabinet 100 to selectively lock the one or more doors 120. A key type locking mechanism 122 is utilized in the collapsible storage cabinet 100 shown in FIGS. 1, 3-5, and 7. However, it is possible to utilize other types of locking mechanisms, such as a combination lock.

Figure 6:
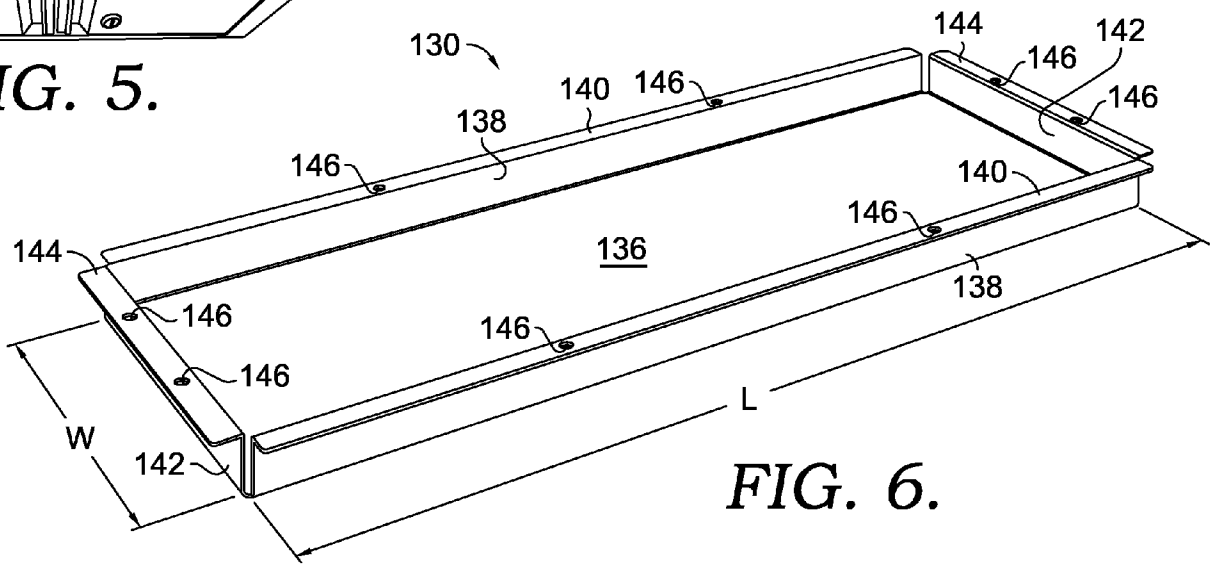
FIG. 6 is a perspective view of a top wall or bottom wall for the storage cabinet of FIG. 1.
Figure 9:
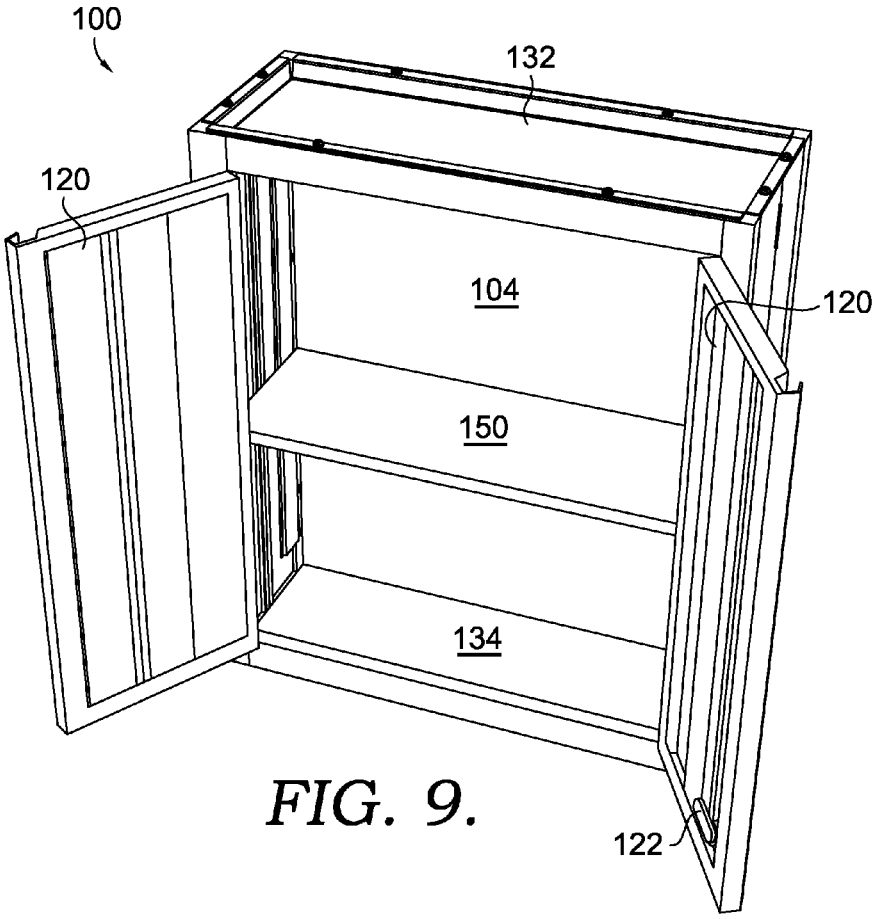
FIG. 9 is a perspective view of the storage cabinet of FIG. 1 in which the door panels are open.

Referring now to FIG. 6, the collapsible storage cabinet 100 also comprises a wall member 130 having a unique structural design. The wall member 130 is preferably used as a top wall 132 and/or a bottom wall 134 for the collapsible storage cabinet 100, as shown in FIGS. 1, 7, and 9. The wall member 130 has a generally planar body 136 having a length dimension L and a width dimension W. The wall member 130 also has a pair of first support walls 138, oriented generally perpendicular to the generally planar body 136, and a pair of first lips 140 that are parallel to the generally planar body 136. The wall member 130 also comprises a pair of second support walls 142, oriented generally perpendicular to the generally planar body 136, as well as the pair of first support walls 138. Each of the second support walls 142 also comprise a second lip 144 which, like the first lip 140, is generally parallel to the generally planar body 136. The first and second lips 140 and 144 each contain one or more openings 146 to aid in securing the top wall 132 and the bottom wall 134 to the collapsible subassembly 101. The one or more openings 146 correspond to respective openings 148 in top and bottom portions of the front wall 102, the back wall 104, and the sidewalls 106, as shown in FIGS. 5 and 7.

The wall member 130, shown in FIG. 6, can be fabricated from a single piece of sheet metal that is cut and formed to the desired shape by a bending process such as a press brake. Utilizing such a process provides an economical and reliable means of fabrication. More specifically, the wall member 130 has a generally planar body 136, which is cut and then folded on each of its four sides to form the first support walls 138 and second support walls 142. Then the first and second lips 140 and 144 are formed by bending a portion of the first and second support walls, 138 and 142, respectively. The one or more openings 146 can be placed in the wall member 130 at a convenient time in the manufacturing process.

Referring back to FIG. 2, the storage cabinet 100 shown in its collapsed and packaged condition. The collapsed condition provides a more compact product to be shipped to retailers. More specifically, the storage cabinet, when collapsed, defines an open region 116, as discussed above. The open region 116 is sized such that the top wall 132, bottom wall 134, one or more shelves 150, and the bracket 105, along with any fasteners, clips, or other hardware, can be placed within the open region 116 for purposes of packaging and shipping the collapsible storage cabinet 100. FIG. 2 also shows how the collapsible storage cabinet 100 fits within a limited amount of disposable packaging 107 (e.g., cardboard), which may or may not include multiple layers and/or padding 109 (e.g., foam) so as to protect the collapsible storage cabinet 100 when in transit.

The storage cabinet 100 of the present invention provides numerous benefits over cabinets of the prior art, some of which are quick and easy assembly, improved structural support, and enhanced storage features. As shown in FIG. 2, the collapsible storage cabinet 100 provides a more efficient packaging, thereby using less storage space for shipping and in retail locations. With respect to assembly of the collapsible storage cabinet 100, once the top wall 132, bottom wall 134, and one or more shelves 150 are removed from the packaged unit in FIG. 2, the collapsible storage cabinet 100 is opened by separating the front wall 102 from the back wall 104, as shown in FIG. 5. Then, once the folding sidewalls 106 are fully extended, the top wall 132 is secured to the upper portion of the front wall 102, the back wall 104 and the sidewalls 106, as shown in FIG. 7. A plurality of removable fasteners 152, such as screws or bolts, are placed through the one or more openings 146 in the first and second lips 140 and 144 and into the corresponding openings 148 in the front wall 102, back wall 104 and sidewalls 106. The corresponding openings 148 may be threaded such that the removable fasteners 152 engage and secure the top wall 132 to the storage cabinet 100. It is possible for other types of fasteners 152 to be used such as ¼ turn fasteners or push pin connectors. The bottom wall 134 is secured to the collapsible storage cabinet 100 in the same manner as the top wall 132. Finally, the one or more shelves 150 are placed in the storage cabinet 100, as shown in FIG. 9.

In the event the storage cabinet 100 is to be collapsed, the one or more shelves 150 are removed, the fasteners 152 are removed, and the top wall 132 and bottom wall 134 are then removed. The storage cabinet 100 can then be collapsed to the flattened condition shown in FIGS. 3 and 4.

The design of the top wall 132 and bottom wall 134 also provide increased structural stability for the storage cabinet 100. Referring to FIG. 8, a partial cross-sectional view of the storage cabinet 100 depicting the top wall 132 is shown. A similar construction occurs with respect to the bottom wall 134. This cross section view of the storage cabinet 100 shows the generally planar body 136, first support walls 138 and first lips 140. The first support walls 138, which are generally perpendicular to the generally planar body 136, are thereby generally parallel to the inner portions of the front wall 102 and back wall 104, providing increased structural rigidity to the collapsible storage cabinet 100, helping to prevent any twisting or lateral movement of the front wall 102 or back wall 104, and helping to prevent collapsing of the folding sidewalls 106. The recessed, tray-like shape of the wall member 130, provides for a portion of the wall member 130 being between the front wall 102, the back wall 104, and the sidewalls 106 when the collapsible storage cabinet 100 is in its fully assembled condition, thereby providing enhanced anti-collapsibility functionality when compared to a flat top or bottom that merely spans across the upper or lower edges of the walls 102, 104, 106.

In addition to the structural benefits discussed above, the geometry of the top wall 132 also provides an enhanced feature for the collapsible storage cabinet 100. That is, the tray-like shape of the top wall 132 allows for additional items, such as small tools or supplies, to be stored on top of the storage cabinet 100 without a risk of them falling or rolling off of the top wall 132.

The collapsible storage cabinet 100 is preferably fabricated from sheet metal such as stainless, galvanized or tool steel. However, for lighter and less rugged applications, it is possible for the collapsible storage cabinet 100 to be fabricated from lighter weight materials, such as plastic.

Figure 11:
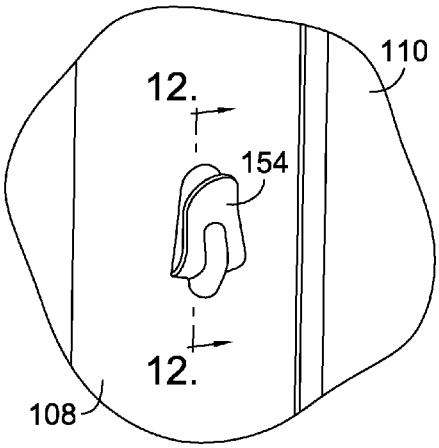
FIG. 11 is an enlarged, fragmentary, perspective view of a tongue arrangement used to support a shelf in the collapsible storage cabinet.
Figure 12:
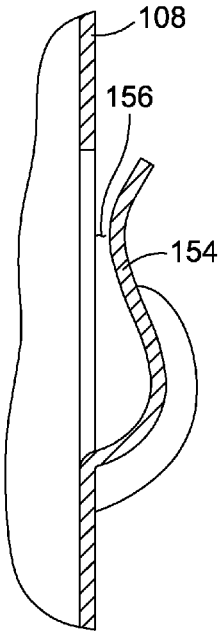
FIG. 12 is cross-sectional view of the tongue arrangement taken along the line 12-12 of FIG. 11.
Figure 13:
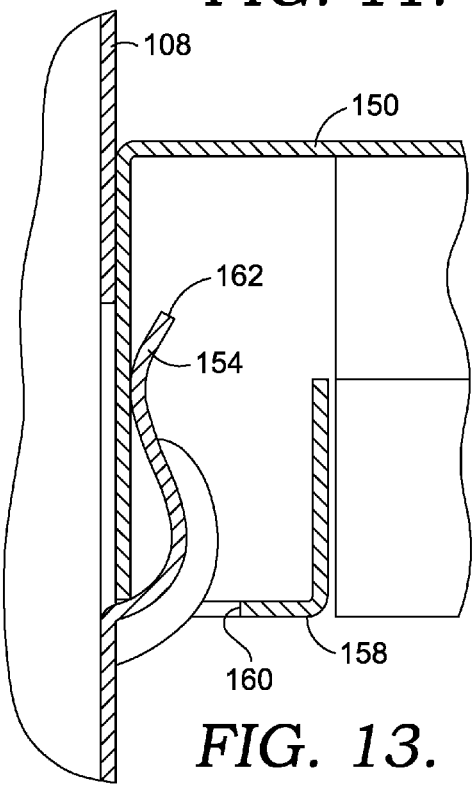
FIG. 13 is the cross-sectional view of FIG. 12, but with a shelf supported on the tongue arrangement.

Turning now to FIGS. 11-13, an alternate method of supporting a shelf in the collapsible storage cabinet 100 is disclosed. To provide increased rigidity to the collapsible storage cabinet 100 when in the fully assembled position, the shelf 150 may be coupled to the hinges 108, one or more panels 110, the sidewalls 106, and/or the back wall 104. With the use of the clips 117 discussed above, the shelf 150 simply sits on the clips 117. However, by replacing the openings 115 and clips 117 with a tongue 154, a more secure connection may be made.

As illustrated in FIG. 11, a tongue 154 may be formed where the opening 115 would otherwise be located. The tongue 154 may be formed by bending a portion of the metal into tongue-like configuration. The tongue 154 defines a space or gap 156 between the tongue 154 and the panel or wall in which it is formed (e.g., hinge 108, sidewall 106, back wall 104, etc.). A bottom portion 158 of the shelf 150 is provided with one or more openings 160. The shelf is placed inside the collapsible storage cabinet 100 when it is in the fully assembled position in a horizontal orientation above the tongues 154. It is then lowered down toward the tongues, wherein a distal end 162 of the tongues 154 are received in the openings 160 in the bottom of the shelf 150. The shelf 150 is lowered until a bottom of the shelf 150 abuts the tongue 154, as illustrated in FIG. 13. A portion of the shelf 150 is pinched between the tongue 154 and the hinge 108 to, in essence, clamp the shelf 150 in place. This makes the shelf 150 more secure, but also ties the panels 110 together and to the shelf, for a more secure arrangement.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

The invention claimed is:

1. A collapsible storage cabinet comprising:

a front wall;

an opposing back wall;

a pair of folding sidewalls extending between and coupling the front wall and back wall;

a top wall removably secured to a top edge of the front wall, a top edge of the back wall, and top edges of the pair of side walls, a portion of which is recessed within a top opening defined by the front wall, the back wall, and the pair of sidewalls, wherein the portion of the top wall recessed within the top opening prevents the sidewalls from folding; and a bottom wall positioned opposite the top wall and removably secured to a bottom edge of the front wall, a bottom edge of the back wall, and bottom edges of the pair of side walls, a portion of which is recessed within a bottom opening defined by the front wall, the back wall, and the pair of sidewalls, wherein the portion of the bottom wall recessed within the bottom opening prevents the sidewalls from folding, wherein the top wall and the bottom wall are stackable within one another such that the portion of the top wall that is recessed within the top opening may be nested within the portion of the bottom wall that is recessed within the bottom opening when the top wall is stacked on top of the bottom wall, wherein the stacked top wall and bottom wall are stored between the two folding sidewalls when the collapsible storage cabinet is in a collapsed position; wherein the portion of the top wall recessed within the top opening is of substantially the same cross-section as the portion of the bottom wall recessed within the bottom opening.

2. The collapsible storage cabinet of claim 1, wherein the front wall further comprises a front frame and one or more door panels.

3. The collapsible storage cabinet of claim 2, wherein the one or more door panels are hinged to the front frame.

4. The collapsible storage cabinet of claim 2, wherein the one or more door panels further comprise a locking mechanism.

5. The collapsible storage cabinet of claim 2, wherein a portion of the top wall is recessed a distance in the top opening and supported by a plurality of support walls that are generally parallel to the front wall and the back wall.

6. The collapsible storage cabinet of claim 1, wherein the pair of folding sidewalls each comprise a plurality of panels connected together by one or more hinges.

7. The collapsible storage cabinet of claim 1, wherein each of the front wall and the back wall further comprise extensions oriented generally perpendicular to the front wall and the back wall and wherein the extensions on the front wall extend toward the rear wall and the extensions on the rear wall extend toward the front wall, whereby the extensions space the front wall from the rear wall when the storage cabinet is in a collapsed position to define an open region there between.

8. A collapsible storage cabinet comprising:

a collapsible subassembly having a front wall, an opposing back wall, and a pair of folding sidewalls extending between and coupling the front wall and back wall; and a plurality of wall members removably coupleable to the collapsible subassembly, the wall members each comprising:

a generally planar body having a length and width;

a pair of first support walls oriented generally perpendicular to the generally planar body, each of the first support walls having a first lip parallel to the generally planar body;

a pair of second support walls oriented generally perpendicular to the generally planar body and to the pair of first support walls, each of the second support walls having a second lip parallel to the generally planar body; and one or more openings in each of the first and second lips, wherein one of the plurality of wall members forms a top wall member of the collapsible storage cabinet that, when coupled to collapsible subassembly, positions the generally planar body of said top wall member intermediate and recessed below top edges of the collapsible subassembly, the first and second lips of said top wall member being positioned on the top edges of the collapsible subassembly, wherein one of the plurality of wall members forms a bottom wall member of the collapsible storage cabinet that, when coupled to collapsible subassembly, positions the generally planar body of said bottom wall member intermediate and recessed above bottom edges of the collapsible subassembly, the first and second lips of said bottom wall member being positioned below the bottom edges of the collapsible subassembly, wherein the top wall member and the bottom wall member are stackable one within the other, wherein when the collapsible storage cabinet is collapsed the stacked top wall member and the bottom wall member are stored within the collapsible subassembly between the pair of folding sidewalls; wherein the portion of the top wall member recessed within the collapsible subassembly is of substantially the same cross-section as the portion of the bottom wall member recessed within the collapsible subassembly.

9. The collapsible storage cabinet of claim 8, wherein the pair of first support walls are adjacent to, but do not contact, the pair of second support walls.

10. The collapsible storage cabinet of claim 8, wherein the one or more openings in the first and second lips correspond to openings in the front wall, the back wall, and the side walls of the collapsible storage cabinet.

11. The collapsible storage cabinet of claim 8, wherein the one or more openings comprise two openings in each of the first and second lips.

12. The collapsible storage cabinet of claim 8, wherein the first and second support walls are formed by bending a portion of the generally planar body.

13. The collapsible storage cabinet of claim 12, wherein the first and second lips are formed by bending a portion of the first and second support walls.

14. A collapsible storage cabinet having a compact collapsed state comprising:

a front wall having a first pair of opposed extensions that extend rearwardly therefrom;

a back wall opposite and parallel to the front wall, the back wall having a second pair of opposed extensions that extend forwardly therefrom;

a pair of collapsible sidewalls connected to both the first pair of extensions of the front wall and the second pair of extensions of the back wall;

wherein each sidewall has a plurality of panels hinged together and to the extensions of the front and back walls, wherein the plurality of panels are generally parallel to each other when the cabinet is in a collapsed position, and wherein the first and second pair of extensions are aligned and adjacent each other when the cabinet is in a collapsed position, whereby the extensions space the front wall from the rear wall thereby defining an open region between the front wall, the back wall, and the pair of sidewalls;

a top wall, a bottom wall, and one or more removable shelves, wherein dimensions of the extensions, the front wall, the back wall, and the side walls are sized to define a volume of the open region sufficient to receive the top wall, the bottom wall, and the one or more shelves therein between the folded side walls when the cabinet is in a collapsed position; and wherein the top wall and the bottom wall each include a concavity configured to permit either of the top wall and the bottom wall to stack such that the concavities nest adjacent to each other wherein the top wall is configured to be mounted on the top edge of the cabinet with the concavity of the top wall extending below the top edge of the cabinet; and wherein the bottom wall is configured to be mounted on the bottom edge of the cabinet with the concavity of the bottom wall extending above the bottom edge of the cabinet; and wherein the concavity of the top wall is of substantially the same cross-section as the concavity of the bottom wall.

15. The collapsible storage cabinet of claim 14, wherein the top and bottom walls are identical in size and shape, wherein the top and bottom walls define recessed portions and wherein the recessed portions are positioned between the front, back and side walls when the cabinet is in a fully assembled state.

16. The collapsible storage cabinet of claim 14, wherein the pair of collapsible sidewalls are connected to the front and back walls via a plurality of hinges, wherein the plurality of hinges include a bracket portion that spans a gap between the extensions and the panels when the cabinet is in a fully assembled position, and wherein the hinges are coupled to an inner face of an extension and an inner face of a panel.

17. The collapsible storage cabinet of claim 16, further comprising one or more removable shelves, wherein the hinges include a plurality of tongues formed therein, wherein the one or more shelves have openings in a bottom thereof for receipt of the tongues to support the one or more shelves thereon, and wherein the tongues couple the one or more shelves to the hinges.

* * * * *